US007464438B1

(12) United States Patent
Marks

(10) Patent No.: US 7,464,438 B1
(45) Date of Patent: Dec. 16, 2008

(54) SECTIONAL DOOR TRACK WITH IMPROVED ROLLER ACCESS

(76) Inventor: Robert T. Marks, 1844 San Miguel Dr., Suite 209, Walnut Creek, CA (US) 94596

( * ) Notice: Subject to any disclaimer, the term of this patent is extended or adjusted under 35 U.S.C. 154(b) by 0 days.

(21) Appl. No.: 11/977,095

(22) Filed: Oct. 24, 2007

Related U.S. Application Data

(60) Provisional application No. 60/855,694, filed on Oct. 30, 2006.

(51) Int. Cl.
*A47H 15/00* (2006.01)

(52) U.S. Cl. ..... 16/91; 16/96 R; 160/201

(58) Field of Classification Search ..... 16/91, 16/96 R, 97, 102, 105–107; 160/201, 130; 49/197
See application file for complete search history.

(56) References Cited

U.S. PATENT DOCUMENTS 928,137 A 7/1909 Lewis
1,902,836 A * 3/1933 Johnson ..... 16/96 R
3,258,062 A 6/1966 Lambert
3,484,812 A * 12/1969 Holland ..... 160/201
5,887,385 A * 3/1999 Horner et al. ..... 49/26
6,840,300 B2 1/2005 Lewis, Jr.
7,219,392 B2 * 5/2007 Mullet et al. ..... 16/96 R
D554,414 S * 11/2007 Sheppard ..... D6/561
2003/0213093 A1 * 11/2003 Perks ..... 16/91

* cited by examiner

*Primary Examiner*—William L. Miller
(74) *Attorney, Agent, or Firm*—Rodgers & Rodgers

(57) ABSTRACT

A sectional door track with improved access to rollers, and methods for using the device are disclosed herein. The sectional door track can be configured to house sectional door rollers operably connected to a sectional door. The door track includes a horizontal segment, a vertical segment, and a curved segment interspersed between horizontal and vertical segments. The door track also includes at least one access door operably connected to one or more of the horizontal and vertical segments of the track. In some embodiments, the access door can be operably connected to one or more of the horizontal and vertical segments of the track by a hinge. In some embodiments, the door track can optionally include a locking ring operably attached to the door track and a locking ring operably attached to the access door. A locking pin configured to slide through the door track locking ring and the access door locking ring to secure the access door in a closed position can also be included.

11 Claims, 5 Drawing Sheets

SECTIONAL DOOR TRACK WITH IMPROVED ROLLER ACCESS

The benefits of 35 U.S.C. 119 are claimed of provisional patent application 60/855,694 filed Oct. 30, 2006.

BACKGROUND

1. Field of the Invention

The invention is directed to an improved door track with an access door for convenient access to sectional door rollers.

2. Description of the Related Art

Sectional overhead doors are commonly used for closing the opening of a building structure, such as a garage, a storefront, a warehouse, and the like. Sectional overhead doors are typically constructed from a series of sectional door panels which are pivotally coupled together along parallel longitudinal edges of the door panels to form a functional door system. A series of rollers extends from each lateral edge of the door panels. The overhead door assembly further includes a track assembly having substantially vertical track sections adjacent opposite sides of the opening of the building, and substantially horizontal track sections extending above an upper portion of the vertical track sections. A curved track section spans between the vertical and horizontal track sections to provide a continuous length of track on opposite sides of the opening. The overhead door is mounted in the track assembly such that the rollers are captured by the track sections, whereby the door can be moved between a generally vertical, closed position covering the opening of the building to a generally horizontal, open position exposing the opening of the building. The vertical track sections are generally attached by brackets to a wall jamb surrounding the opening in the building. The horizontal track sections can be suspended by brackets attached to a ceiling above the horizontal track sections. The vertical track sections are generally inclined in a direction which increases the spacing between the vertical track section and the wall jamb toward an upper portion of the vertical track section, to facilitate engagement of the door with the wall jamb when the door is moved from an open position to a closed position.

Replacing or servicing broken, worn out, or defective door rollers of installed sectional doors can be a difficult and time-consuming process. To do so, the curved track section is physically bent away, the roller pushed out of the track, and the sectional door pried forward such that the roller clears the track, which then allows the roller to be removed from its attachment to the sectional door. Once a new roller has been placed, the above process is reversed and the curved track segment is physically bent back in place to retain the roller within the track. The physical bending of the track and prying of the sectional door can lead to damage and deformation of both the track as well as the sectional door.

What is needed is an improved sectional door track that provides for rapid, convenient access to the door rollers to facilitate servicing and replacement of the rollers without needing to physically deform the door track or remove the installed sectional door.

STATEMENT OF THE INVENTION

In one aspect, the invention includes a door track for facilitating access to track rollers. The door track includes a horizontal segment, a vertical segment, and a curved segment interspersed between horizontal and vertical segments. The door track also includes at least one access door operably connected to one or more of the horizontal and vertical segment of the track. In some embodiments, the access door can be operably connected to one or more of the horizontal and vertical segment of the track by a hinge. In some embodiments, the door track can optionally include a locking ring operably attached to the door track and a locking ring operably attached to the access door. A locking pin configured to slide through the door track locking ring and the access door locking ring to secure the access door in a closed position can also be included.

Also described herein is a method for removing a door roller housed within a door track. A door track configured to support the door roller is provided. The door track includes an access door operably attached to one or more of a horizontal and vertical segment of the track. The access door can then be opened. Next, the door roller is uncoupled from a sectional door. Next, the door roller can be removed from the door track via an access door. The door roller can then be repaired or replaced. The repaired or replacement door roller can be reinserted through the access door and coupled to the sectional door. The access door can then be closed.

DETAILED DESCRIPTION OF THE PREFERRED EMBODIMENT

Figure 1:
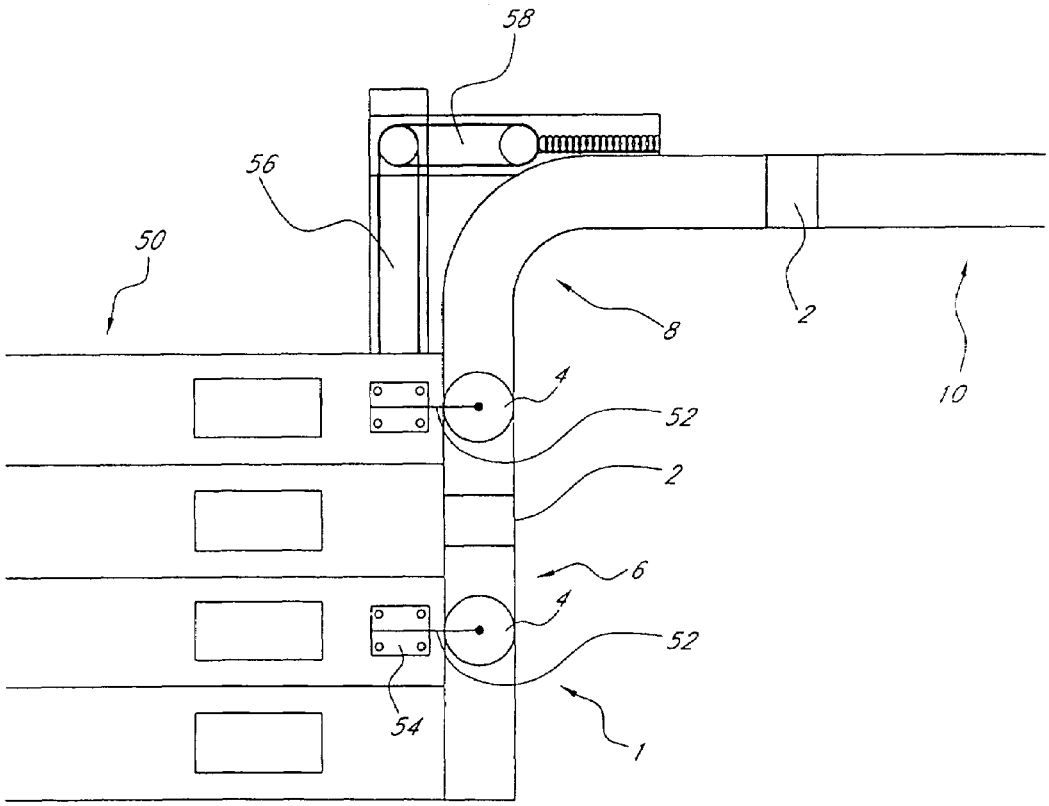
FIG. 1 is a schematic diagram of a door track attached to a sectional door, according to one embodiment of the invention.

FIG. 1 illustrates a schematic diagram of an improved sectional door track assembly. The track assembly includes one or more door tracks 1. In one preferred embodiment, the track assembly includes two door tracks 1. Each door track 1 has a substantially vertical segment 6 (also referred to herein as a vertical segment 6) as well as a substantially horizontal segment 10 (also referred to herein as a horizontal segment 10) extending above an upper portion of the substantially vertical segment 6. A curved segment 8 of the track 1 spans between the vertical 6 and horizontal 10 segments of the track 1 to provide a continuous length of track on either side of the opening of a sectional door 50. However, in some embodiments, the track 1 can include only a substantially horizontal segment 6 or a substantially vertical segment 10. In some embodiments, the track 1 can be made of a metal, such as aluminum.

With continued reference to FIG. 1, the track 1 includes one or more access doors 2 configured to allow for replacement of rollers 4 that roll along the track 1 to facilitate opening and closing of the sectional door 50. Rollers 4 are operably connected to roller shafts 52 which are in turn can be operably attached to a hinge 54 on the sectional door. The sectional door 50, in some embodiments, can be opened by pulleys 56, 58. In a preferred embodiment, at least one access door 2 is preferably present along the vertical 6 as well as the horizontal 10 track segments as shown. In other embodiments, the track 1 includes one access door 2 for every roller 4. Access doors 2 can be located anywhere along the length of track 1 although in some embodiments the access doors 2 are spaced and positioned along the track 1 to conveniently allow for replacement of the rollers 2 when the sectional door 50 is in a closed position. In still other embodiments, an access door 2 can be positioned along the curved portion 8 of the track 1, in addition to or instead of access doors 2 on the vertical 6 and/or horizontal 10 segments of the track 1. The track 1 can be secured to a building structure at one or more locations by bolts, nails, adhesives, or other means.

Figure 2:
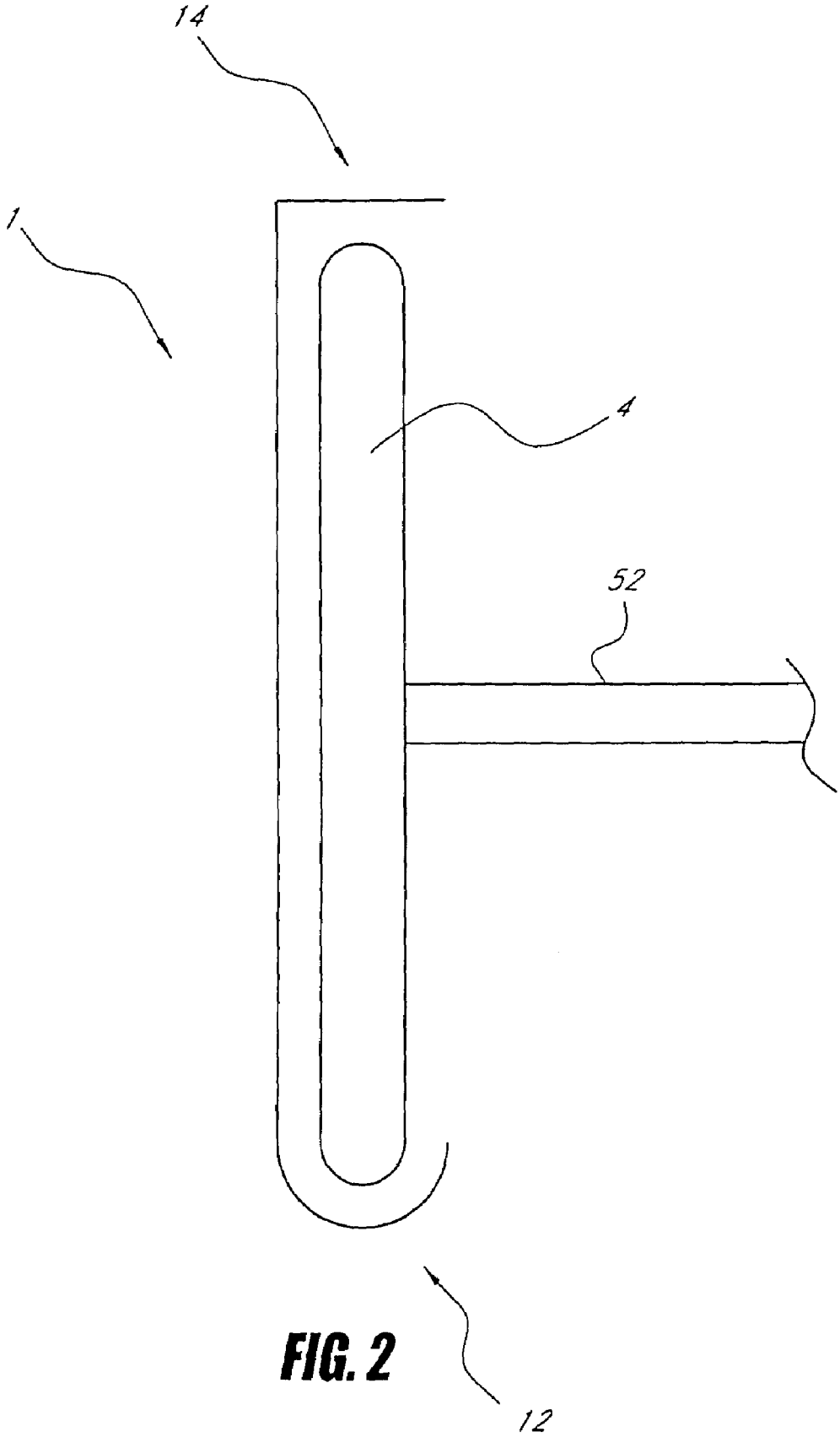
FIG. 2 is a vertical sectional view of a segment of a door track, according to one embodiment of the invention.

FIG. 2 illustrates a cross-sectional end view of the horizontal segment 10 of the track 1. Track 1 is preferably sized to allow rollers 4, connected to their roller shafts 52 to move along the length of the track 1 during operation of the sectional door 50. To facilitate this, the track 1 also most preferably has a roller-supporting portion 12 that is configured to maintain the rollers 4 within the track 1 as they roll along the length of the track 1, thus preventing the rollers 4 from "derailing." The roller-supporting portion 12 is preferably located at the inferior edge (relative to the floor of a building structure) of the horizontal segment 10 of the track 1 and on the distal edge (with respect to the sectional door) of the vertical segment 6 (not shown). Track 1 also has an access-door supporting portion 14, opposite roller-supporting portion 12 described in more detail in connection with FIG. 3 below.

Figure 3:
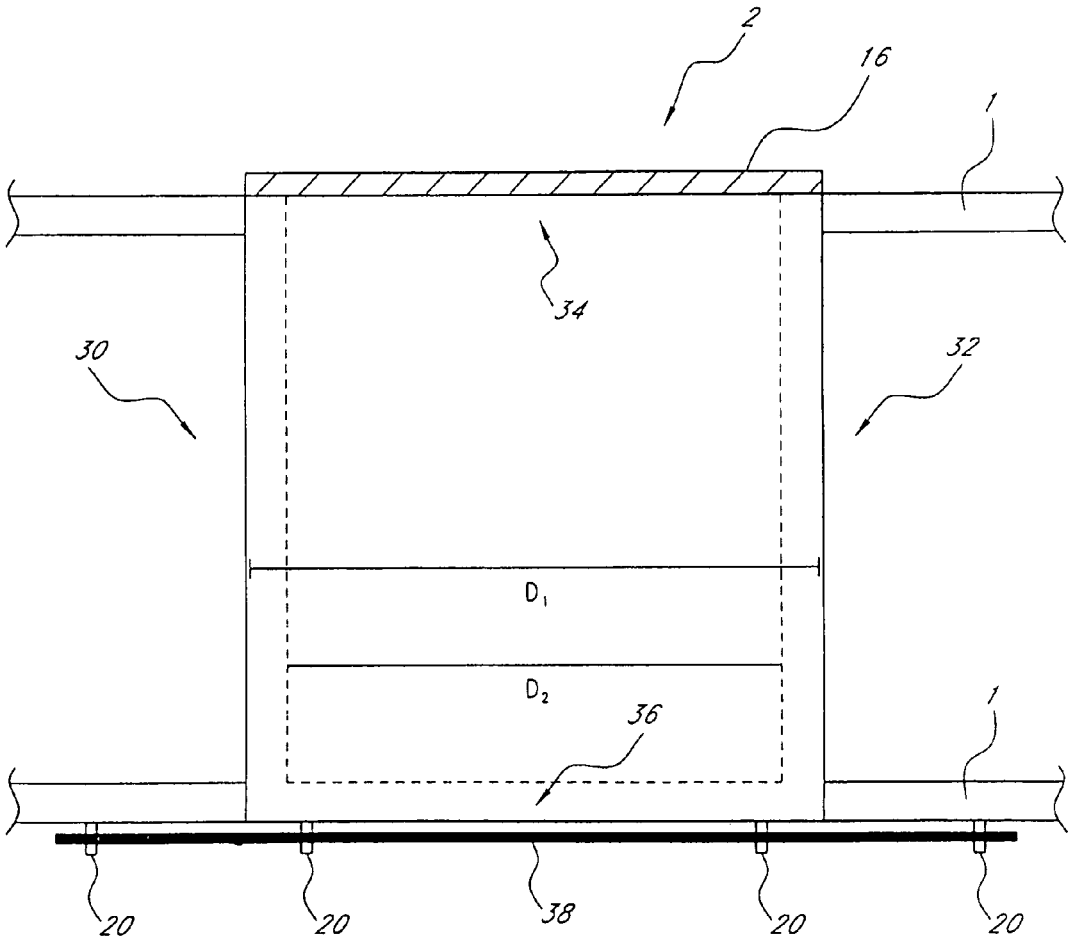
FIG. 3 is a schematic diagram of an access door operably attached to a door track, according to one embodiment of the invention.

FIG. 3 shows a schematic diagram of an access door 2 on the track 1. In some embodiments, door 2 is preferably square or rectangular-shaped, although other door shapes are also possible. In the embodiment shown, access door 2 has four edges, an upper edge 34, lower edge 36, and two side edges 30, 32. Access door 2 can be made of metal, wood, plastic, glass, or other suitable material. In some embodiments, access door 2 is at least partially transparent or translucent such that a roller 4 within the track 1 can be visualized through access door while access door 2 is in a closed position to better facilitate replacement or repair of the roller 4. Access door 2 is preferably sized and configured such that a distance D1 representing the width of the access door 2 (distance between edges 30 and 32) is larger than the diameter D2 of a roller 4 within the track 1, in order to facilitate repair or replacement of rollers 4 which can conveniently be removed from the track 1 via access door 2. Access door 2 is also preferably sized such that width D1 of the access door 2 is slightly larger than the width of an aperture in track 1 created when access door 2 is in an open position. In some embodiments, width D1 of the access door 2 is ⅛", ¼", ⅜", ½" or more larger than the width of an aperture in the track 1.

With continued reference to FIG. 3, access door 2 is operably connected to track 1 such that access door 2 can be actuated from a closed position to an open position, allowing for replacement of the rollers 4. In one embodiment as shown, the access door 2 is preferably attached at edge 34 to the track 1 by a hinge 16 attached at the access door-supporting portion 14 of the track 1. However, one of ordinary skill in the art will appreciate that many other attachment techniques of the access door 2 to the track 1 are possible. Thus, the access door 2 can be configured to open, for example, upwardly, downwardly, right to left, or left to right depending on the placement of hinge 16 on the track, in embodiments where a hinge 16 is utilized. In other embodiments, the access door 2 can reside on its own separate access door track such that the access door 2 can be slidably opened. In some embodiments, the access door 2 can also include a knob, pull-cord, or the like to facilitate manual opening of the door 2. In still other embodiments, the access door 2 can be opened by electromechanical means, such as a motor actuator.

With continued reference to FIG. 3, in some embodiments, access door 2 includes one or more locking rings 20. Locking rings 20 are preferably located along, and operably attached to edge 36 of access door 2. One or more locking rings 20 are also operably attached to the track 1, preferably along the roller-supporting portion 12. Locking rings 20 of both access door 2 and track 1 are configured to receive a locking pin 38. Insertion of the locking pin 38 through locking rings 20 of both access door 2 and track 1 will secure access door 2 in a closed position to prevent inadvertent derailment of rollers 4 out of the track 1. Likewise, removal of locking pin 38 will allow movement of access door 2 to an open position. In some embodiments, access door 2 can be configured to maintain an open position without manually holding the access door 2 open to advantageously facilitate removal or replacement or rollers 4. In some embodiments, the locking pin 38 preferably further extends lengthwise along track 1 past locking rings 20 of the track 1 and snugly abuts the track 1 in order to advantageously reinforce the structural integrity of the track 1. The locking pin 38 as well as locking rings 20 can be made of metal or other suitable material.

One of ordinary skill in the art will also recognize that many other ways to releasably secure access door 2 in a closed position other than the locking pin 38-locking ring 20 combination are possible. For example, access door 2 can include a cylinder lock in lieu of the locking pin 38-locking ring 20 combination.

Figure 4A:
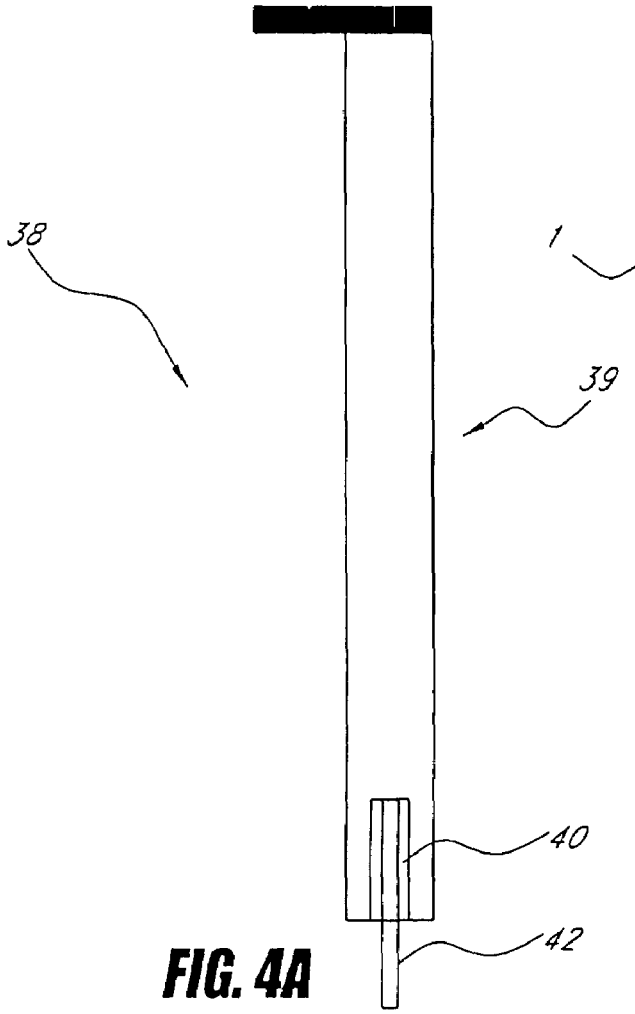
FIG. 4A is a top view of a locking pin and a rotating locking tab, according to one embodiment of the invention.

FIG. 4A illustrates a top view of a locking pin 38, according to some embodiments of the invention. Locking pin 38 includes an elongate body 39 that can be generally tubular in some embodiments. Locking pin 38 also can include a slot 40 configured to receive a rotating locking tab 42. Rotating locking tab 42 is preferably configured to have a diameter larger than the diameter of the locking rings 20 of the access door 2 and the track 1 in a first configuration to prevent locking pin 38 from sliding completely in a first direction through a locking ring. In a second configuration (for example, when locking tab 42 is rotated 90 degrees in some embodiments), locking tab 42 has a diameter less than that of the locking rings 20 in order to facilitate removal of the locking pin 38, such as when the access door 2 needs to be opened.

Figure 4C:
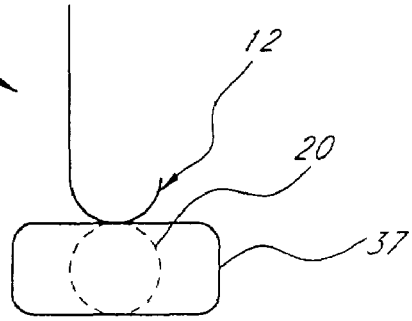
FIG. 4C is a vertical sectional schematic illustrating a locking pin, locking ring, and door track, according to one embodiment of the invention.
Figure 4B:
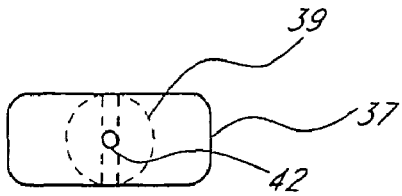
FIG. 4B is an end view of the locking pin and rotating locking tab of FIG. 4A.

FIG. 4B is an end view of locking pin 38 illustrating schematically the spatial relationship of rotating locking tab 42 within the slot 40 of locking pin 38 within the elongate body 39. Also shown is the head of locking pin 37.

As illustrated in FIG. 4C, pin head 37 resides at the end of locking pin 38 opposite from slot 40 and rotating locking tab 42. Pin head 37 is preferably oversized and configured to prevent locking pin 38 from sliding completely in a second direction through a locking ring 20. This second direction is generally 180 degrees from first direction described above. As illustrated in FIG. 3 above, locking ring 20 is preferably operably attached to the underside of roller-supporting portion 12 of the track 1.

Figure 5:
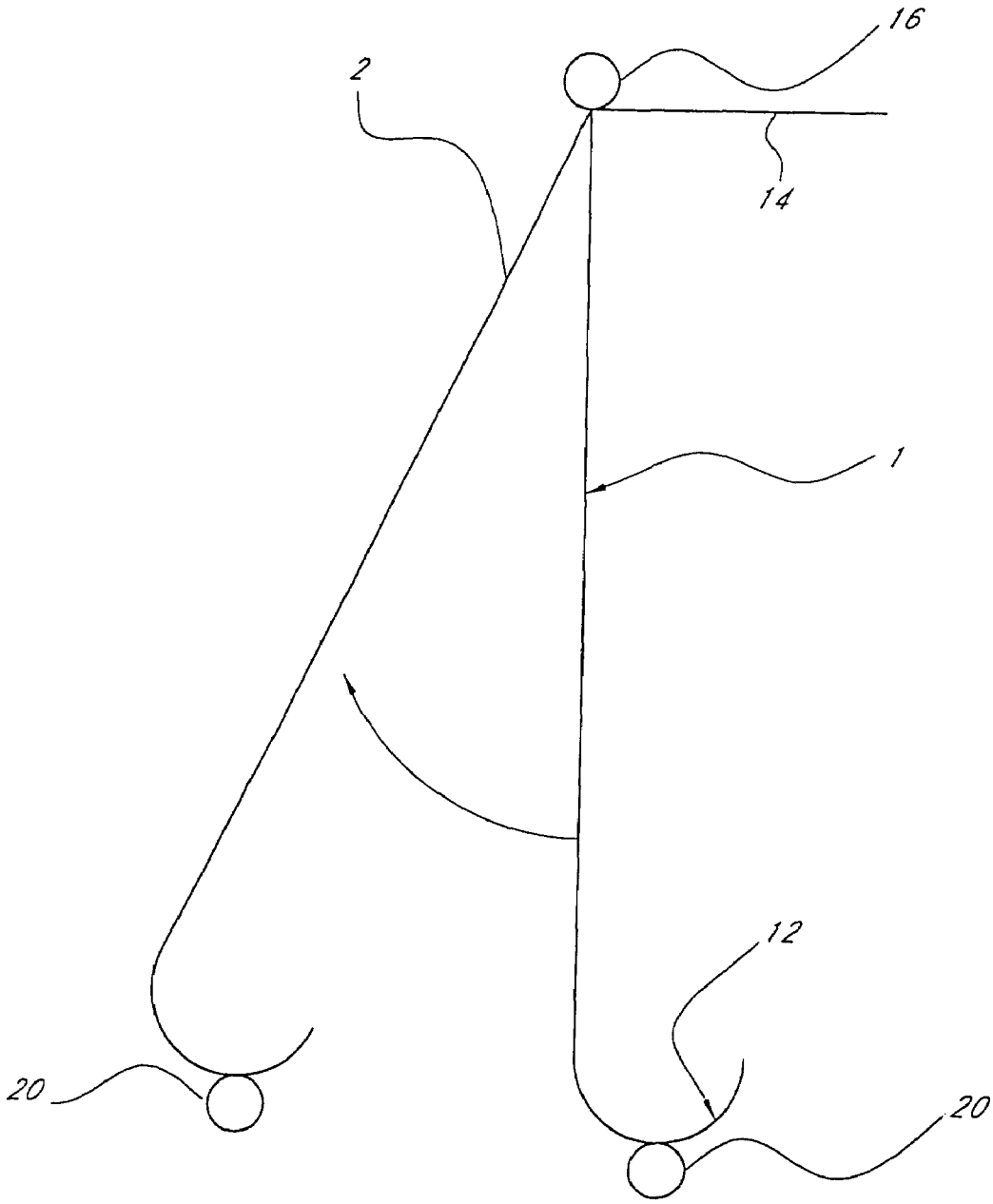
FIG. 5 is a schematic end view of an access door and the door track, according to one embodiment of the invention.

FIG. 5 illustrates a schematic end view of access door 2. In some embodiments, as described, access door 2 is pivotably attached to track 1 by a hinge 16. The hinge 16 can be spot welded to a flat portion of access door-supporting portion 14 of the track 1. Also shown is locking rings 20 of the access door 2 and track 1. When access door 2 is in a closed position, locking rings 20 are preferably aligned to allow locking pin 38 (not shown) to be inserted through locking rings 20 to secure access door 2 in a closed position as well as to reinforce a length of track 1.

Although this invention has been disclosed in the context of certain preferred embodiments and examples, it will be understood by those skilled in the art that the present invention extends beyond the specifically disclosed embodiments to other alternative embodiments and/or uses of the invention and modifications thereof. Thus, it is intended that the scope of the present invention herein disclosed should not be limited by the particular disclosed embodiments described above.

The invention claimed is:

1. A sectional door track comprising a substantially horizontal segment, a substantially vertical segment, said horizontal and vertical segments interconnected by a curved segment, roller-supporting portions secured respectively to one edge of said horizontal and vertical segments, said roller supporting portions maintaining at least one roller within said track; and access-door supporting portions secured respectively to the opposite edges of said horizontal and vertical segments, planar portions extending respectively between said roller-supporting portions and said access-door supporting portions, an aperture formed in one of said planar portions, an access door secured to said access-door supporting portion adjacent said aperture, said access door movable between a closed position covering said aperture and an open position exposing said aperture such that said at least one roller is accessible, and said access door being pivoted to said access-door supporting portion.

2. A track according to claim 1 wherein said access door is hinged to said access-door supporting portion, said access door pivots from said closed position to said open position, and in the closed position covers said aperture.

3. A track according to claim 2 wherein at least one locking ring is secured along the edge of said access door opposite said hinge.

4. A track according to claim 3 wherein at least one locking ring is secured to said roller-supporting portion adjacent said aperture.

5. A track according to claim 4 wherein a locking pin extends through said at least one locking ring.

6. A track according to claim 5 wherein said locking pin comprises a slot formed in one end thereof and a rotating locking tab is disposed within said slot.

7. A track according to claim 6 wherein a pin head is secured to the end of said locking pin opposite said slot.

8. A track according to claim 1 wherein the width of said access door is larger than the width of said aperture.

9. A track according to claim 1 wherein said access door is transparent.

10. A track according to claim 1 wherein said access door is translucent.

11. A method of securing a door roller housed within a door track, said track comprising horizontal and vertical segments interconnected by a curved segment, an aperture formed in one of said segments, an access door pivoted to one of said segments and covering said aperture, the method comprising the steps of aligning one of said rollers within said aperture, pivoting said access door to an open position, removing said roller from said door through said aperture, replacing a roller onto said door through said aperture, and pivoting said access door to a closed position.

* * * * *